US007182626B2

(12) United States Patent
Langolf

(10) Patent No.: US 7,182,626 B2
(45) Date of Patent: Feb. 27, 2007

(54) ELECTRICAL CONNECTOR WITH IMPROVED LATCH MEANS

(75) Inventor: David Langolf, Ortonville, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/103,173

(22) Filed: Apr. 11, 2005

(65) Prior Publication Data

US 2006/0228938 A1 Oct. 12, 2006

(51) Int. Cl.
*H01R 13/58* (2006.01)

(52) U.S. Cl. ..... 439/473

(58) Field of Classification Search ..... 439/473, 439/466, 465, 467

See application file for complete search history.

(56) References Cited

U.S. PATENT DOCUMENTS 4,108,527 A * 8/1978 Douty et al. ..... 439/465
5,033,976 A * 7/1991 Sarian et al. ..... 439/467
5,259,785 A * 11/1993 Inaba et al. ..... 439/466
5,295,859 A * 3/1994 Kawai et al. ..... 439/455
5,688,144 A * 11/1997 Kosuge ..... 439/596
6,095,852 A * 8/2000 Gregory, II ..... 439/540.1
6,276,960 B1 * 8/2001 Schaefer et al. ..... 439/522
6,364,693 B1 * 4/2002 Stagg et al. ..... 439/467

* cited by examiner

*Primary Examiner*—Gary F. Paumen
(74) *Attorney, Agent, or Firm*—Romi N. Bose

(57) ABSTRACT

A electrical connector includes a dielectric housing member for mounting a plurality of terminals. A cover member is engaged with the housing member and combines therewith to define an interior cavity for receiving thereinto a plurality of electrical wires for termination to the terminals. Latches are interengaged between the dielectric housing member and the cover member to hold the members together. The latches include an elongated flexible latch arm projecting from one of the members through the interior cavity into locking engagement with the other member. An open-sided protective silo projects from the one member into the interior cavity alongside the elongated latch arm. The arm is flexible into and out of the open side of the silo. Therefore, the silo protects the elongated flexible latch arm and prevents overflexing thereof.

13 Claims, 3 Drawing Sheets

ELECTRICAL CONNECTOR WITH IMPROVED LATCH MEANS

FIELD OF THE INVENTION

This invention generally relates to the art of electrical connectors and, particularly, to an improved latch means for holding a cover on a connector housing.

BACKGROUND OF THE INVENTION

Generally, an electrical connector includes some form of insulative or dielectric housing which mounts one or more conductive terminals. The housing typically includes a terminating face at one end or side thereof and an opposite mating face configured for mating with a complementary mating connector or other connecting device which, itself, has one or more conductive terminals. The terminals of the connector typically have terminating ends exposed at the terminating face of the housing and contact ends located at the mating face of the housing for electrically engaging the terminals of the complementary mating connector.

Electrical connectors of the character described above are used in a wide variety of applications ranging from electrical signal connectors to pure electrical power connectors, both of which may be terminated to various conductors ranging from discrete electrical cables or wires to printed circuit boards.

Still further, a connector assembly typically includes a pair of mating connectors, such as plug and receptacle connectors sometimes called male and female connectors. In order to hold or lock the pair of connectors in mated conditions, the connectors typically include some form of interengaging latch means therebetween.

One type of electrical connector includes a dielectric housing mounting a plurality of terminals which are terminated to a plurality of discrete electrical wires. A cover is engaged over the terminating end of the housing and combines therewith to define an interior cavity into which the wires are inserted through a mouth between the housing and the cover. The cover must be latched to the housing to hold the cover thereon. Typically, one or more flexible latch arms are provided on the outside of either the cover or the housing for engagement with latching surfaces on the other of the cover or housing. For instance, many such connectors include two latches on opposite sides of the cover and housing. These latches continue to create various problems. For instance, the latches are susceptible to disengagement when the electrical wires are pulled from side to side. This is particularly true when the wires are gathered into a bundle which provides an easy means for an operator to grasp and pull on the connector. In addition, the latch arms are easily damaged during shipping, handling and assembly. Heretofore, latches have not been provided interiorly of the housing and cover of these types of connectors because they would interfere with the electrical wires inserted into the assembly. The present invention is directed to solving this myriad of problems.

SUMMARY OF THE INVENTION

An object, therefore, of the invention is to provide a new and improved latching system for an electrical connector of the character described.

In the exemplary embodiment of the invention, the connector includes a dielectric housing member for mounting a plurality of terminals. A cover member is engaged with the housing member and combines therewith to define an interior cavity for receiving thereinto a plurality of electrical wires for termination to the terminals. Latch means are interengaged between the dielectric housing member and the cover member to hold the members together. The latch means include an elongated flexible latch arm projecting from one of the members through the interior cavity into locking engagement with the other member. An open-sided protective silo projects from the one member into the interior cavity alongside the elongated latch arm. The arm is flexible into and out of the open side of the silo. The silo protects the elongated flexible latch arm and also prevents over-flexing thereof.

According to one aspect of the invention, the flexible latch arm has a latch hook near a distal end thereof projecting away from the silo and engageable with a latch surface on the other member. In the preferred embodiment, the silo projects beyond a distal end of the flexible latch arm.

According to another aspect of the invention, the silo is generally U-shaped in cross-section as defined by a back wall and a pair of side walls. The flexible latch arm is flexible toward and away from the back wall between the side walls. In the preferred embodiment, the flexible latch arm is generally flat in a plane generally parallel to the back wall of the silo.

According to a further aspect of the invention, the other member has a latch shoulder engageable by the flexible latch arm of the one member. The latch shoulder is substantially surrounded by a shroud which projects from the other member into the interior cavity. In the preferred embodiment, the latch shoulder is defined by a edge of an opening in the other member. The opening is substantially surrounded by the shroud.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
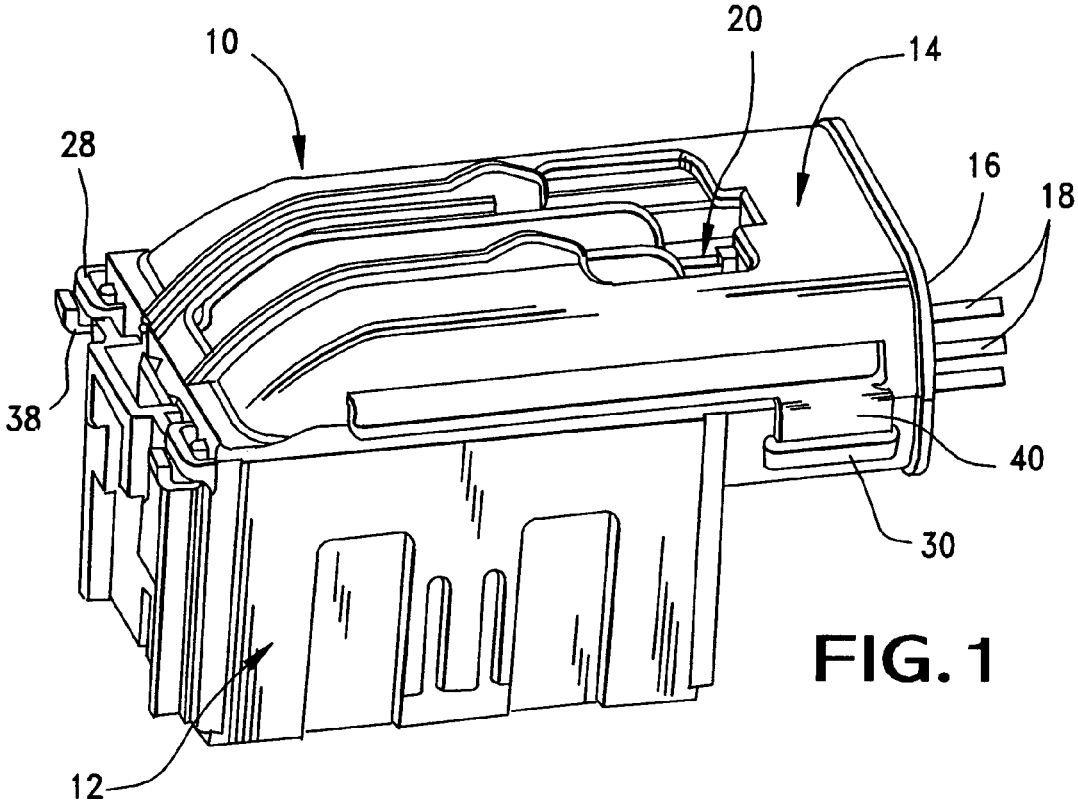
FIG. 1 is a top perspective view of an electrical connector embodying the concepts of the invention.
Figure 2:
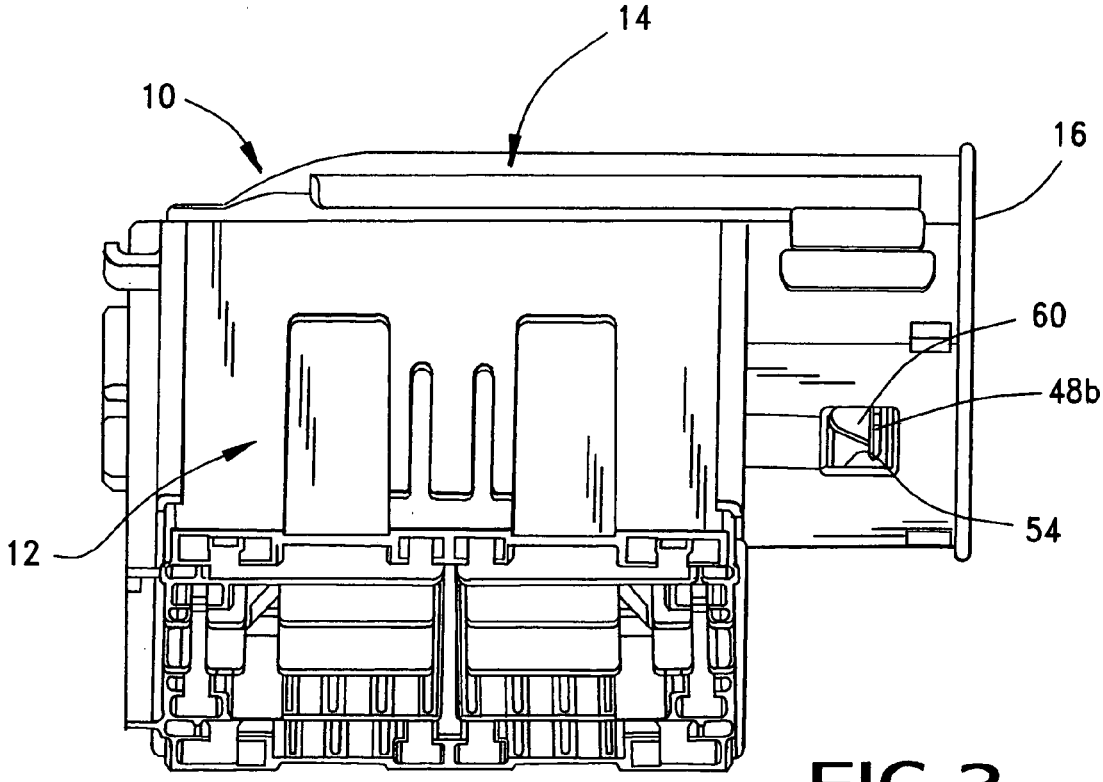
FIG. 2 is a bottom perspective view of the connector.
Figure 3:
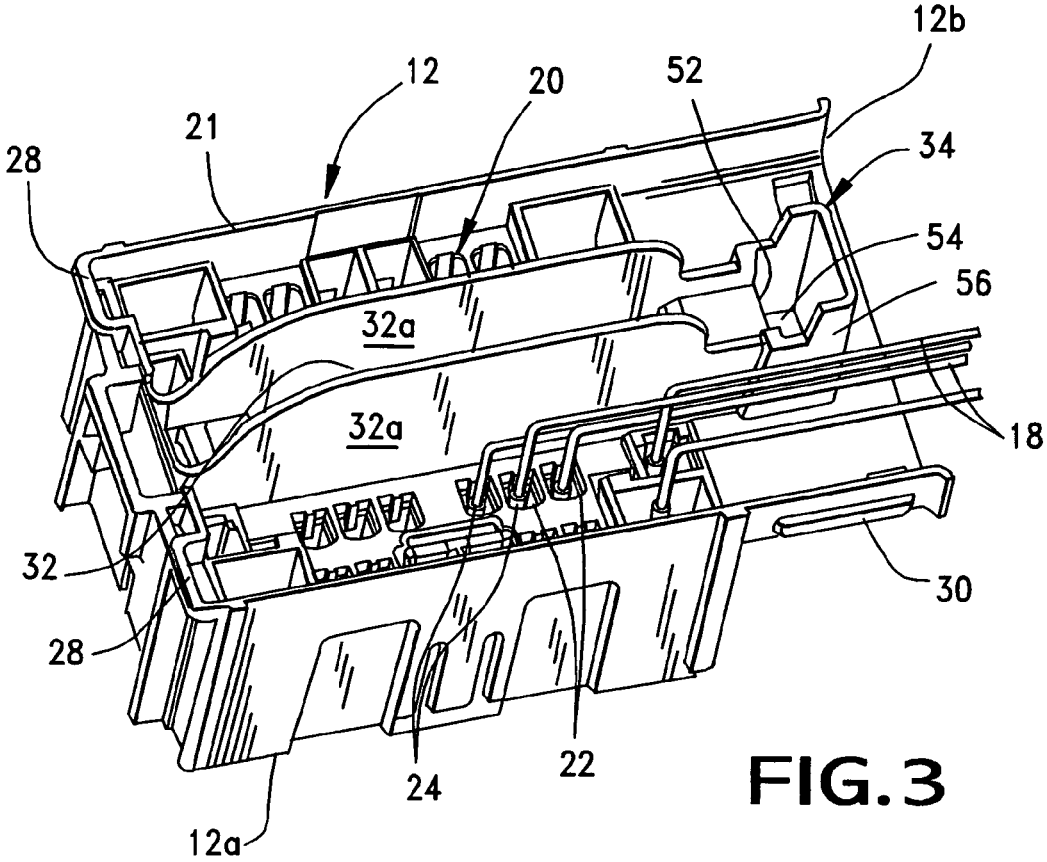
FIG. 3 is a top perspective view of the housing of the connector.
Figure 4:
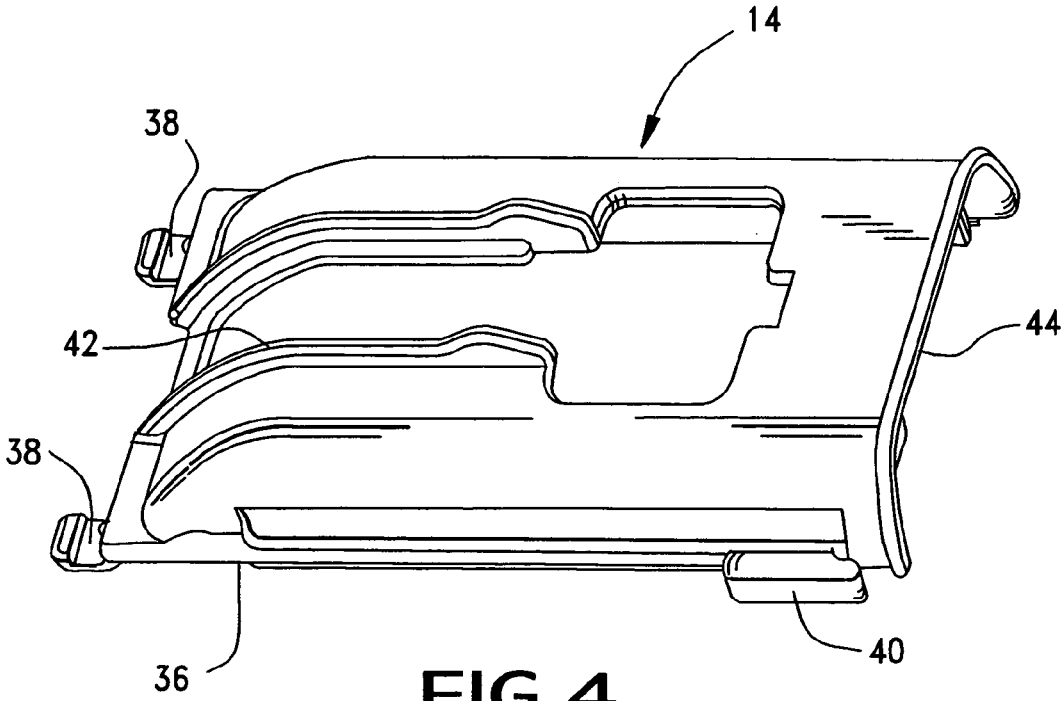
FIG. 4 is a top perspective view of the cover for the connector.
Figure 5:
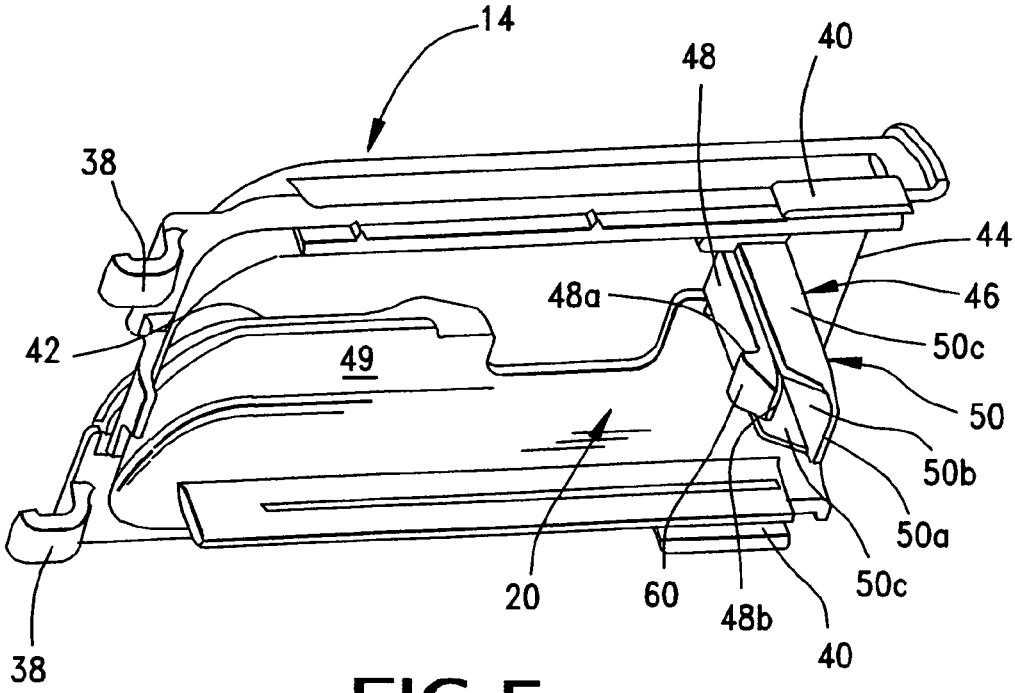
FIG. 5 is a bottom perspective view of the cover.

Referring to the drawings in greater detail, the invention is embodied in an electrical connector, generally designated 10, shown in its assembled condition in FIGS. 1 and 2. The connector includes two basic components, namely an insulative or dielectric housing, generally designated 12, and a cover, generally designated 14. The housing is shown in FIG. 3, and the cover is shown in FIGS. 4 and 5. The connector has a mating face 14 for mating with a complementary mating connector or other connecting device. The connector has a terminating face 16 into which a plurality of discrete electrical wires 18 are inserted. The cover and the housing combine to define an interior cavity, generally designated 20, and which is only partially visible in FIG. 1.

More particularly, and referring to FIG. 3 in conjunction with FIGS. 1 and 2, housing 12 is a one-piece structure which can be unitarily molded of dielectric material such as plastic or the like. The housing has a mating end 12*a* which defines the mating face 14 (FIGS. 1 and 2) of the connector. The housing has a terminating end 12*b* which combines with the cover to form the terminating face 16 (FIGS. 1 and 2) of the connector. The housing has a rectangular, top peripheral edge 21. The housing has a plurality of terminal-receiving passages 22 for mounting a plurality of terminals 24. The terminals are terminated to electrical wires 18 within the interior cavity 20. Only a few of the terminals and wires are shown in the drawings to avoid cluttering the clear depiction. The housing has a pair of positioning bridges 28 at the front thereof and a pair of latching ribs 30 at opposite sides thereof near the rear of the housing. An enlarged opening 32 is bounded by a pair of parallel internal walls 32*a* for receiving a mating assist lever (not shown) which is not part of the invention herein. Finally, the housing has a primary interior latch structure, generally designated 34, which will be described in greater detail hereinafter.

Referring to FIGS. 4 and 5 in conjunction with FIGS. 1 and 2, cover 14 has a bottom peripheral edge 36 which is rectangular and conforms with top peripheral edge 21 of the housing. When the cover is mounted to the housing, bottom peripheral edge 36 of the cover abuts top peripheral edge 21 of the housing.

Cover 14 has a pair of positioning hooks 38 which are inserted into positioning bridges 28 of the cover. In assembly, the cover is oriented generally vertically relative to the housing; positioning hooks 38 are inserted downwardly into positioning bridges 28; and the cover then is rotated downwardly to the assembled position shown in FIG. 1; whereas positioning hooks 38 rotate into engagement beneath positioning bridges 28 as can be seen clearly in FIGS. 1 and 2. A pair of latching flanges 40 on opposite sides of cover 14 snap into latching engagement with latching ribs 30 on the housing as seen in FIG. 1. The cover has an enlarged opening 42 which aligns with enlarged opening 32 of the housing for receiving the mating assist lever. The cover is open at its rear end 44 and combines with terminating end 12*b* of the housing to form an access opening to interior cavity 20 for insertion thereinto of electrical wires 18. Finally, cover 14 has an interior primary latch structure, generally designated 46, which is operatively associated with primary latch structure 34 of the housing to securely lock the cover to the housing.

Figure 6:
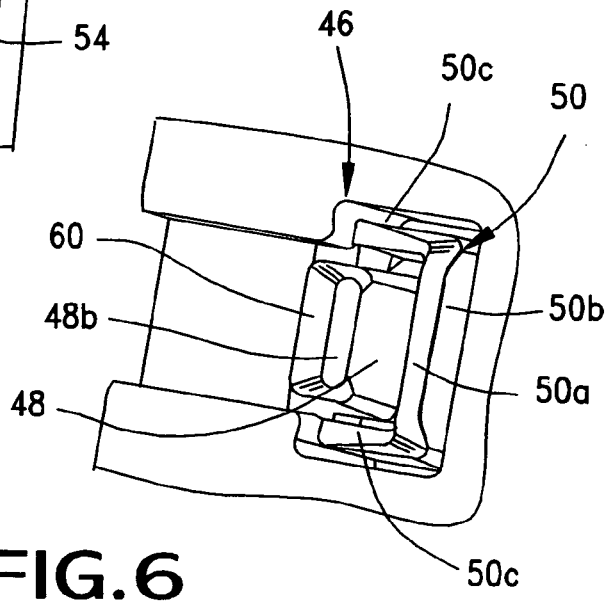
FIG. 6 is an enlarged, fragmented perspective view of the interior latch arm and silo of the cover.

The invention is directed primarily to the interior or internal latching system provided by primary latch structures 34 and 46 on housing 12 and cover 14, respectively. Referring to FIG. 6 in conjunction with FIG. 5, primary latch structure 46 on cover 14 includes an elongated flexible latch arm 48 which projects inwardly from a top wall 49 of the cover into the interior cavity 20 formed between the cover and the housing. The flexible latch arm is long and flat and has a latch hook 48*a* at a distal end 48*b* of the arm. The latch hook projects away from an open-sided protective silo, generally designated 50. Like the latch arm, silo 50 is elongated and projects inwardly from top wall 50 of the cover into interior cavity 20 alongside the latch arm. The silo has a distal end 50*a* which projects beyond distal end 48*b* of the latch arm to protect the end of the arm. The silo is generally U-shaped in cross-section as defined by a back wall 50*b* and a pair of side walls 50*c*. Flexible latch arm 48 is flexible into and out of the open side of the U-shaped silo. In other words, the flexible latch arm is flexible toward and away from back wall 50*b* between side walls 50*c*. The silo performs a first function of protecting the elongated flexible latch arm 48, and a second function of preventing the latch arm from over-flexing.

Figure 7:
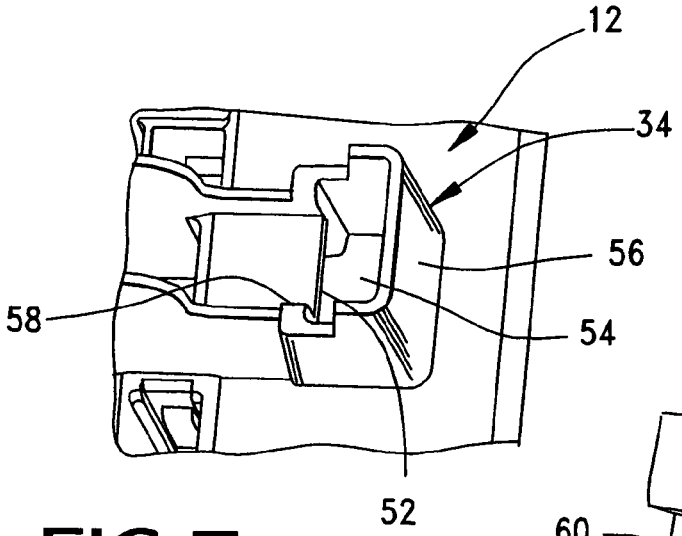
FIG. 7 is an enlarged, fragmented perspective view of the area of the interior shroud on the housing of the connector.

Referring to FIG. 7 in conjunction with FIG. 3, primary latch structure 34 on housing 12 has a latch surface or shoulder 52 defined by a front edge of a through opening 54. The opening and the latch shoulder are substantially surrounded by a generally U-shaped shroud 56. The inside of the shroud is open, as at 58. Like silo 50 of cover 14, shroud 56 projects inwardly into interior cavity 20.

As cover 14 is positioned onto housing 12 by inserting positioning hooks 38 of the cover into positioning bridges 28 of the housing, and the cover is pivoted downwardly about the positioning hooks as described above, silo 50 performs a third function of guiding the cover onto the housing as the silo slides into shroud 56 inside the housing. During the final movement of the cover onto the housing, a chamfered bottom surface 60 (FIG. 5) of latch hook 48*a* on flexible latch arm 48 engages latch shoulder 52 on the housing. As the latch hook passes the latch shoulder, latch arm 48 will "snap" back forwardly to move latch hook 48*a* into primary latching engagement with latch shoulder 52 to securely hold or lock the cover onto the housing.

Finally, by providing latch shoulder 52 at an edge of through opening 54 in the housing, distal end 48*b* of flexible latch arm 48 is exposed exteriorly of connector 10 as can be seen clearly in FIG. 2. Therefore, if it is necessary to raise or remove cover 14 from housing 12 to gain access to interior cavity 20, an operator simply inserts his finger or an appropriate tool through opening 54 at the underside of the connector and flexes arm 48 back into silo 50 to disengage latch hook 48*a* from latch shoulder 52, whereupon the cover can be raised and removed if necessary.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector (10), comprising:

a dielectric housing member (12) for mounting a plurality of terminals (24):

a cover member (14) engaged with the housing member and combining therewith to define an interior cavity (20) for receiving thereinto a plurality of electrical wires (18) for termination to the terminals; and latch means (34,46) interengaged between the dielectric housing member and the cover member to hold the members together and including an elongate flexible latch arm (48) projecting from one of the members through the interior cavity into latching engagement with the other member, an open-sided protective silo (50) projecting from said one member into the interior cavity alongside the elongated latch arm, said latch arm (48) being flexible into and out of the open side of the silo (50), whereby the silo (50) protects the elongated flexible latch arm (48) and prevents over-flexing thereof.

2. The electrical connector of claim 1 wherein said flexible latch arm (48) has a latch hook (48*a*) near a distal end (48*b*) thereof projecting away from the silo (50) and engageable with a latch surface (52) on the other member.

3. The electrical connector of claim 1 wherein said silo (50) projects beyond a distal end (48*b*) of the flexible latch arm (48).

4. The electrical connector of claim 1 wherein said silo (50) is generally U-shaped in cross-section as defined by a back wall (50*b*) and a pair of side walls (50*c*), the flexible latch arm (48) being flexible toward and away from the back wall between the side walls.

5. The electrical connector of claim 4 wherein said flexible latch arm (48) is generally flat in a plane generally parallel to the back wall (50*b*) of the silo (50).

6. The electrical connector of claim 1 wherein said other member has a latch shoulder (52) engageable by the flexible latch arm (48) of the one member.

7. The electrical connector of claim 6 wherein said latch shoulder (52) is substantially surrounded by a shroud (56) which projects from the other member into the interior cavity (20).

8. The electrical connector of claim 7 wherein said latch shoulder is defined by an edge (52) of an opening (54) in the other member, the opening being substantially surrounded by said shroud (56).

9. An electrical connector (10), comprising:

a dielectric housing member (12) for mounting a plurality of terminals (24);

a cover member (14) engaged with the housing member and combining therewith to define an interior cavity (20) for receiving thereinto a plurality of electrical wires (18) for termination to the terminals; and latch means (34,46) interengaged between the dielectric housing member and the cover member to hold the members together and including an elongated flexible latch arm (48) projecting from one of the members through the interior cavity into latching engagement with the other member, an open-sided protective silo (50) projecting from said one member into the interior cavity alongside the elongated latch arm and beyond a distal end of the arm, said silo (50) being generally U-shaped in cross-section as defined by a back wall (50*b*) and a pair of side walls (50*c*), and said latch arm (48) being flexible into and out of the open side of the silo toward and away from the back wall of the silo between he side walls thereof and the latch arm having a latch hook (48*a*) near the distal end thereof projecting away from the silo.

10. The electrical connector of claim 9 wherein said flexible latch arm (48) is generally flat in a plane generally parallel to the back wall (50*b*) of the silo (50).

11. The electrical connector of claim 9 wherein said other member has a latch shoulder (52) engageable by the flexible latch arm (48) of the one member.

12. The electrical connector of claim 11 wherein said latch shoulder (52) is substantially surrounded by a shroud (56) which projects from the other member into the interior cavity (20).

13. The electrical connector of claim 12 wherein said latch shoulder is defined by a edge (52) of an opening (54) in the other member, the opening being substantially surrounded by said shroud (56).

* * * * *